US008068762B2

(12) United States Patent
Yamaguchi

(10) Patent No.: US 8,068,762 B2
(45) Date of Patent: Nov. 29, 2011

(54) IMAGE FORMING DEVICE HAVING A POSITIONING MECHANISM FOR POSITIONING AN EXPOSURE UNIT

(75) Inventor: Takuya Yamaguchi, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 652 days.

(21) Appl. No.: 12/109,855

(22) Filed: Apr. 25, 2008

(65) Prior Publication Data

US 2008/0292359 A1 Nov. 27, 2008

(30) Foreign Application Priority Data

Apr. 27, 2007 (JP) ..... 2007-118278

(51) Int. Cl.
*G03G 15/00* (2006.01)

(52) U.S. Cl. ..... 399/110

(58) Field of Classification Search ..... 399/110, 399/18, 118, 125; 347/138
See application file for complete search history.

(56) References Cited

U.S. PATENT DOCUMENTS

| | | | | |
|---|---|---|---|---|
| 5,019,867 | A * | 5/1991 | Yamakawa et al. | 399/119 |
| 5,477,306 | A | 12/1995 | Iguchi et al. | |
| 5,978,626 | A * | 11/1999 | Nagamine et al. | 399/125 |
| 6,252,619 | B1 * | 6/2001 | Ueda et al. | 347/138 |
| 6,545,693 | B2 | 4/2003 | Kitayama et al. | |
| 2007/0009281 | A1 | 1/2007 | Sato et al. | |

FOREIGN PATENT DOCUMENTS

| | | | |
|---|---|---|---|
| JP | 62-149051 | | 9/1987 |
| JP | 63-018367 | A | 1/1988 |
| JP | 2-071278 | A | 3/1990 |
| JP | 3-198067 | A | 8/1991 |
| JP | 5-241386 | A | 9/1993 |
| JP | 06-106814 | | 4/1994 |
| JP | 06-130746 | | 5/1994 |
| JP | 07-052447 | | 2/1995 |
| JP | 08-142445 | | 6/1996 |
| JP | 8-189518 | A | 7/1996 |
| JP | 09193452 | A * | 7/1997 |

(Continued)

OTHER PUBLICATIONS

JP Office Action dtd Jan. 7, 2010, JP Appln. 2007-118278, English translation.

(Continued)

*Primary Examiner* — Quana M Grainger
(74) *Attorney, Agent, or Firm* — Banner & Witcoff, Ltd

(57) ABSTRACT

An image forming device includes an exposure unit having an exposure surface, an opposed surface facing the exposure surface, a first side surface connecting the exposure surface with the opposed surface, and a second side surface facing the first side surface, a positioning mechanism positioning the exposure unit with respect to a photoconductive body, the positioning mechanism including a first contact member contacting the exposure unit in a first contact point at a side of the first side surface, a second contact member contacting the exposure unit in a second contact point at the side of the first side surface, and a third contact member contacting the exposure unit in a third contact point at a side of the second side surface, the third contact point being located between the first contact point and the second contact point in a predetermined direction from the exposure surface toward the opposed surface.

15 Claims, 17 Drawing Sheets

FOREIGN PATENT DOCUMENTS

| | | | |
|---|---|---|---|
| JP | 09-319173 | | 12/1997 |
| JP | 11-153893 | A | 6/1999 |
| JP | 2000-181165 | | 6/2000 |
| JP | 2000-181165 | A | 6/2000 |
| JP | 2002-014524 | | 1/2002 |
| JP | 2003-112446 | | 4/2003 |
| JP | 2007-102152 | A | 4/2007 |

OTHER PUBLICATIONS

JP Office Action dtd Apr. 21, 2009, JP Appln. 2007-118278.

* cited by examiner

IMAGE FORMING DEVICE HAVING A POSITIONING MECHANISM FOR POSITIONING AN EXPOSURE UNIT

CROSS-REFERENCE TO RELATED APPLICATION

This application claims priority under 35 U.S.C. §119 from Japanese Patent Application No. 2007-118278 filed on Apr. 27, 2007. The entire subject matter of the application is incorporated herein by reference.

BACKGROUND

1. Technical Field

The following description relates to one or more image forming devices such as a copy machine and printer, which are configured to selectively expose an electro-photoconductive body with an exposure unit so as to form a latent image on the electro-photoconductive body, and develop the latent image with developer so as to transfer the latent image onto a recording medium.

2. Related Art

In a conventional image forming device such as a copy machine and a printer, a laser scanning method or below-mentioned LED exposure method has been realized as an image writing method (exposure method). The LED exposure method is a method for forming a latent image on a photoconductive body by exposing a surface of the photoconductive body to light which is emitted by a light emitting unit with a plurality of light emitting elements linearly aligned and converged by a converging unit. FIG. 16 schematically shows a conventional positioning mechanism for positioning an LED head 212 with respect to a main body. There are provided three fitting portions for the positioning in total at both ends of the LED head 212.

Specifically, there are provided at an end of the LED head 212, a circular hole 221 at a lower portion, and a groove 223 at an upper portion. A lower fitting portion 200*b* of a pin 200 is fitted into the circular hole 221, and an upper fitting portion 200*c* of the pin 200 is fitted into along the groove 223. At the other end of the LED head 212, a root portion 232*b* of a pin 232 is fitted into an oval hole 222 formed as a through-hole.

Meanwhile, the LED head 212 is mounted on two pedestals respectively provided at front and rear sides thereof, and positioned in a height direction (y-axis direction) by adjusting the heights of the pins 200 and 232 with respect to base members 223 and 224, respectively.

In addition, the fitting portion 200*b* of the pin 200 and the root portion 232*b* of the pin 232 are fitted into the circular hole 221 and oval hole 222, respectively, and a radial fitting allowance is provided each between the circular hole 221 and fitting portion 200*b* and between the oval hole 222 and root portion 232*b*. The fitting allowance is provided for the sake of easy operations of attaching/detaching the LED head 212 and preventing a stress that may be generated in the LED head 212 by restricting spans of the main body and LED head 212 in the device as thermally-expanded (for example, see Japanese Patent Provisional Publication No. 2002-14524).

SUMMARY

However, according to the aforementioned conventional mechanism, the fitting allowance provided each between the circular hole 221 and fitting portion 200*b* and between the oval hole 222 and root portion 232*b* results in that each of the circular hole 221, oval hole 222, fitting portion 200*b*, and root portion 232*b* has to be machined with very high accuracy so as to regulate the amount of backlash that may be caused due to the fitting allowance. Accordingly, it is unfortunate that each of the circular hole 221, oval hole 222, fitting portion 200*b*, and root portion 232*b* requires a long manufacturing time and high manufacturing cost.

Aspects of the present invention are advantageous in that there can be provided one or more improved image forming devices in which an LED head can easily be positioned with respect to a photoconductive body without having to provide any fitting allowance.

According to aspects of the present invention, there is provided an image forming device, which includes a first device body having an opening, a second device body attached to the first device body in an openable and closable manner so as to cover the opening of the first device body, a photoconductive body, provided to the first device body, which is configured with a circumferential surface thereof endlessly-movable in a predetermined moving direction, an exposure unit, provided to the second device body, which is configured to scan and expose the circumferential surface of the photoconductive body with light in a predetermined scanning direction such that a latent image is formed on the circumferential surface, the exposure unit including an exposure surface configured to emit therefrom the light for the scanning operation, an opposed surface disposed to face the exposure surface, a first side surface disposed to connect the exposure surface with the opposed surface, and a second side surface disposed to face the first side surface, and a positioning mechanism configured to position the exposure unit with respect to the photoconductive body when the second device body is closed, the positioning mechanism including, a first contact member configured to contact the exposure unit in a first contact point at a side of the first side surface, a second contact member configured to contact the exposure unit in a second contact point at the side of the first side surface, and a third contact member configured to contact the exposure unit in a third contact point at a side of the second side surface, the third contact point being located between the first contact point and the second contact point in a predetermined direction from the exposure surface toward the opposed surface.

In some aspects of the invention, when the second device body provided with the exposure unit is closed with respect to the first device body, the exposure unit is positioned by the first contact member that contacts the exposure unit in the first contact point at the side of the first side surface, the second contact member that contacts the exposure unit in the second contact point at the side of the first side surface, and the third contact member that contacts the exposure unit in the third contact point at the side of the second side surface. The third contact point is located between the first contact point and the second contact point in a predetermined direction from the exposure surface toward the opposed surface. Thus, the exposure unit can easily be positioned with respect to the photoconductive body provided to the first device body by the first to third contact members establishing contact therewith.

According to another aspect of the present invention, there is provided an image forming devices which includes a photoconductive body configured with a circumferential surface thereof endlessly-movable in a predetermined moving direction, an exposure unit configured to scan and expose the circumferential surface of the photoconductive body with light in a predetermined scanning direction such that a latent image is formed on the circumferential surface, the exposure unit including, an exposure surface configured to emit therefrom the light for the scanning operation, an opposed surface disposed to face the exposure surface, a first side surface disposed to connect the exposure surface with the opposed surface, and a second side surface disposed to face the first side surface, and a positioning mechanism configured to position the exposure unit with respect to the photoconductive body, the positioning mechanism including a first contact member configured to contact the exposure unit in a first contact point at a side of the first side surface, a second contact member configured to contact the exposure unit in a second contact point at the side of the first side surface, and a third contact member configured to contact the exposure unit in a third contact point at a side of the second side surface, the third contact point being located between the first contact point and the second contact point in a predetermined direction from the exposure surface toward the opposed surface.

With the image forming device configured as above, the exposure unit is positioned by the first contact member that contacts the exposure unit in the first contact point at the side of the first side surface, the second contact member that contacts the exposure unit in the second contact point at the side of the first side surface, and the third contact member that contacts the exposure unit in the third contact point at the side of the second side surface. The third contact point is located between the first contact point and the second contact point in a predetermined direction from the exposure surface toward the opposed surface. Thus, the exposure unit can easily be positioned with respect to the photoconductive body by the first to third contact members establishing contact therewith.

BRIEF DESCRIPTION OF THE ACCOMPANYING DRAWINGS

FIG. 1 is a cross-sectional view schematically showing an entire image forming device 5 in a first embodiment according to one or more aspects of the present invention.

FIG. 2 schematically shows the image forming device in a state where an upper case is shut so as to close a mechanical unit from the state shown in FIG. 1 where the upper case is open in the first embodiment according to one or more aspects of the present invention.

Figure 16:
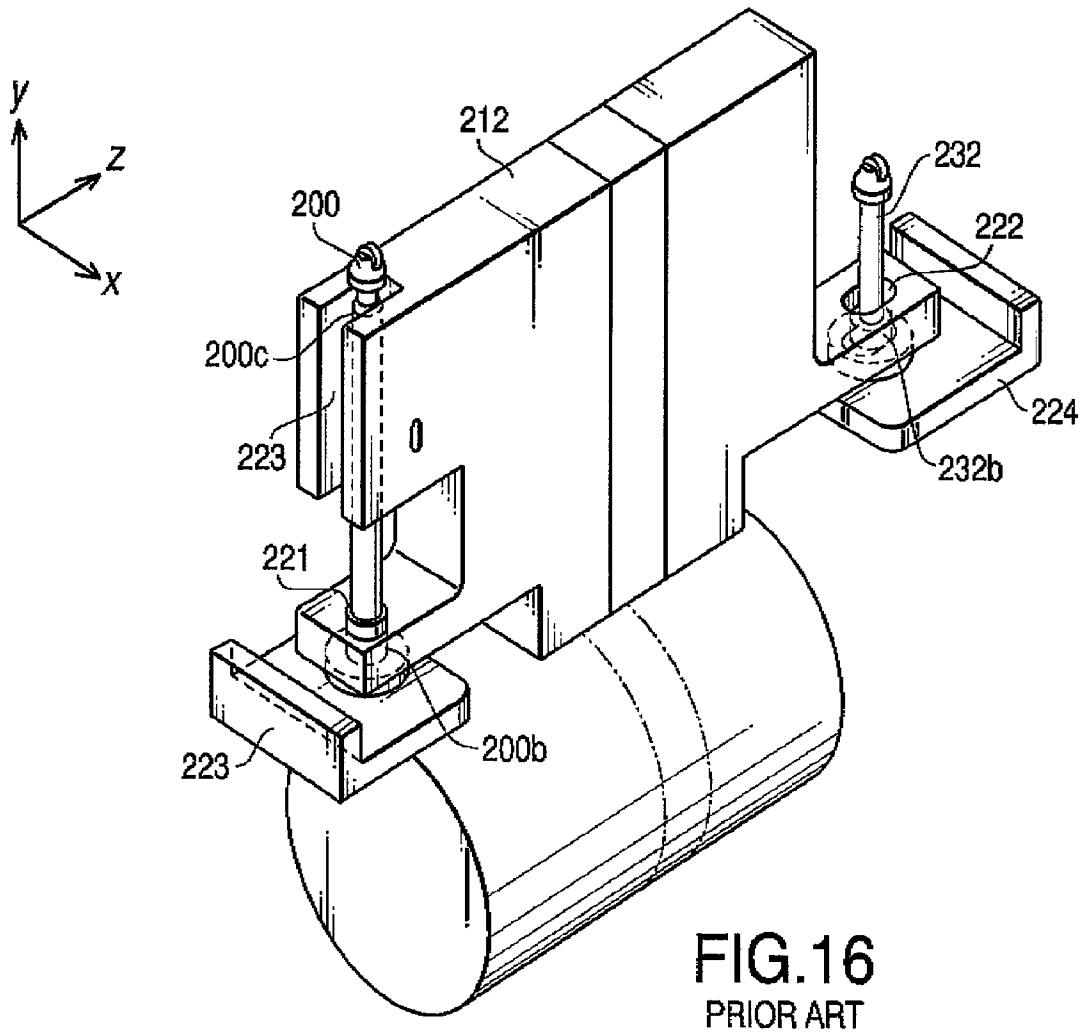
FIG.16 PRIOR ART

FIG. 16 schematically shows a positioning mechanism for positioning an LED head with respect to a main body in a conventional image forming device.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, embodiments according to aspects of the invention will be described with reference to the accompanying drawings.

Figure 1:
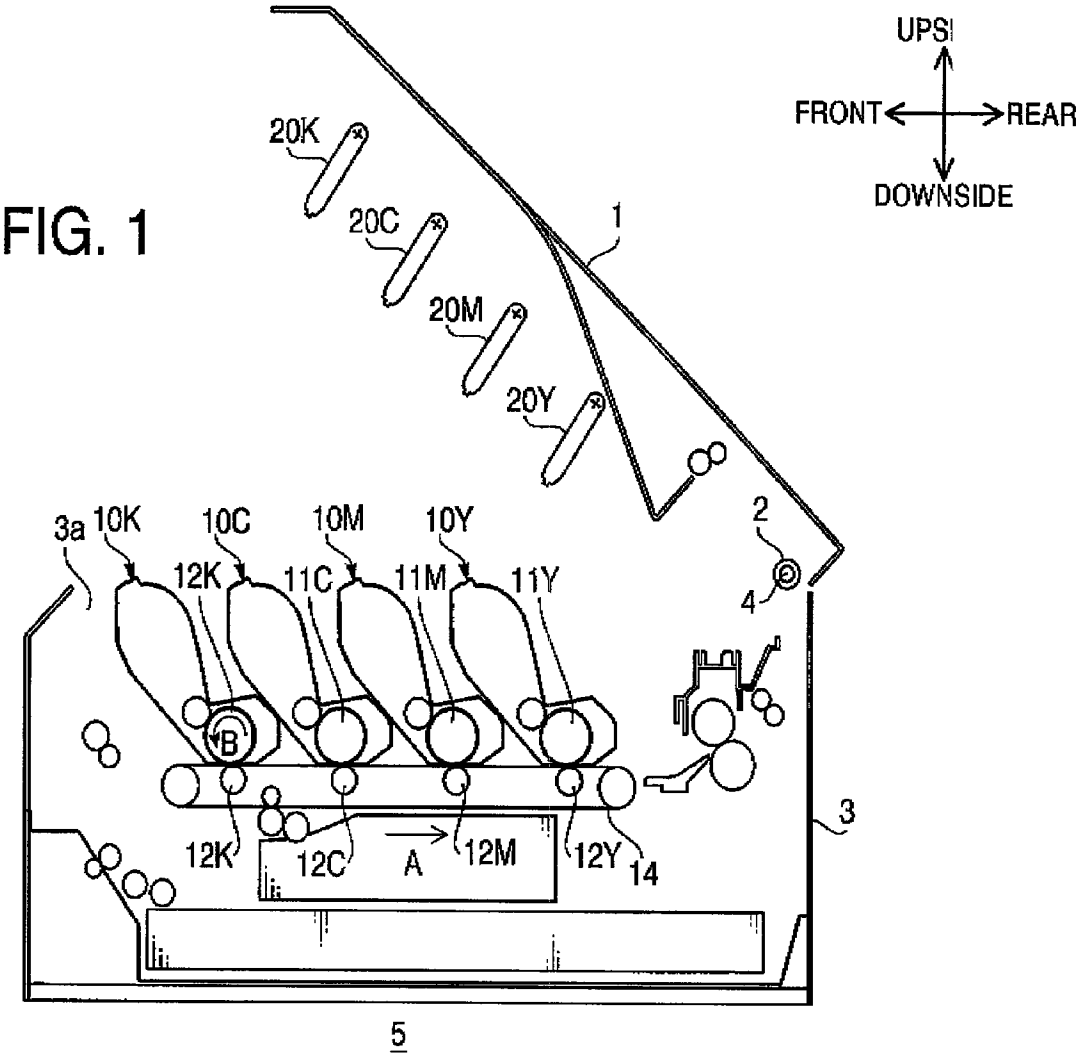

FIG. 1 is a cross-sectional view schematically showing an entire image forming device 5 in a first embodiment according to aspects of the present invention. It is noted that, in FIG. 1, the left side, right side, back side, and front (near) side of the figure are defined as a front side, rear side, left side, and right side of the image forming device 5, respectively.

In FIG. 1, an upper case 1 is supported with a spindle shaft 4 provided at a rear side of a mechanical unit 3 being attached into a spindle hole 2 provided at a rear side of the upper case 1 so as to be rotatable around the spindle shaft 4 with respect to the mechanical unit 3 having an opening 3*a* at an upper side thereof.

In the mechanical unit 3, there are detachably arranged in an arrow A direction in which a recording paper is conveyed, four drum units 10K, 10C, 10M, and 10Y which respectively correspond to Black (K), Cyan (C), Magenta (M), Yellow (Y) in sequence from an upstream side.

There are provided to the drum units 10K, 10C, 10M, and 10Y, respective photoconductive bodies 11K, 11C, 11M, and 11Y which are rotatable in an arrow B direction and respective transfer rollers 12K, 12C, 12M, and 12Y which correspond to the photoconductive bodies 11K, 11C, 11M, and 11Y. The recording paper is carried in the arrow A direction in a state absorbed to a conveying belt 14 owing to collaboration between the photoconductive bodies 11K, 11C, 11M, and 11Y and transfer rollers 12K, 12C, 12M, and 12Y which are rotated in accordance with the photoconductive bodies. Then, images with a predetermined different color each are transferred onto the conveyed recording paper in sequence.

Meanwhile, the upper case 1 has respective four LED units 20K, 20C, 20M, and 20Y provided in positions corresponding to circumferential surfaces of the respective photoconductive bodies 11K, 11C, 11M, and 11Y of the drum units 10K, 10C, 10M, and 10Y.

Figure 2:
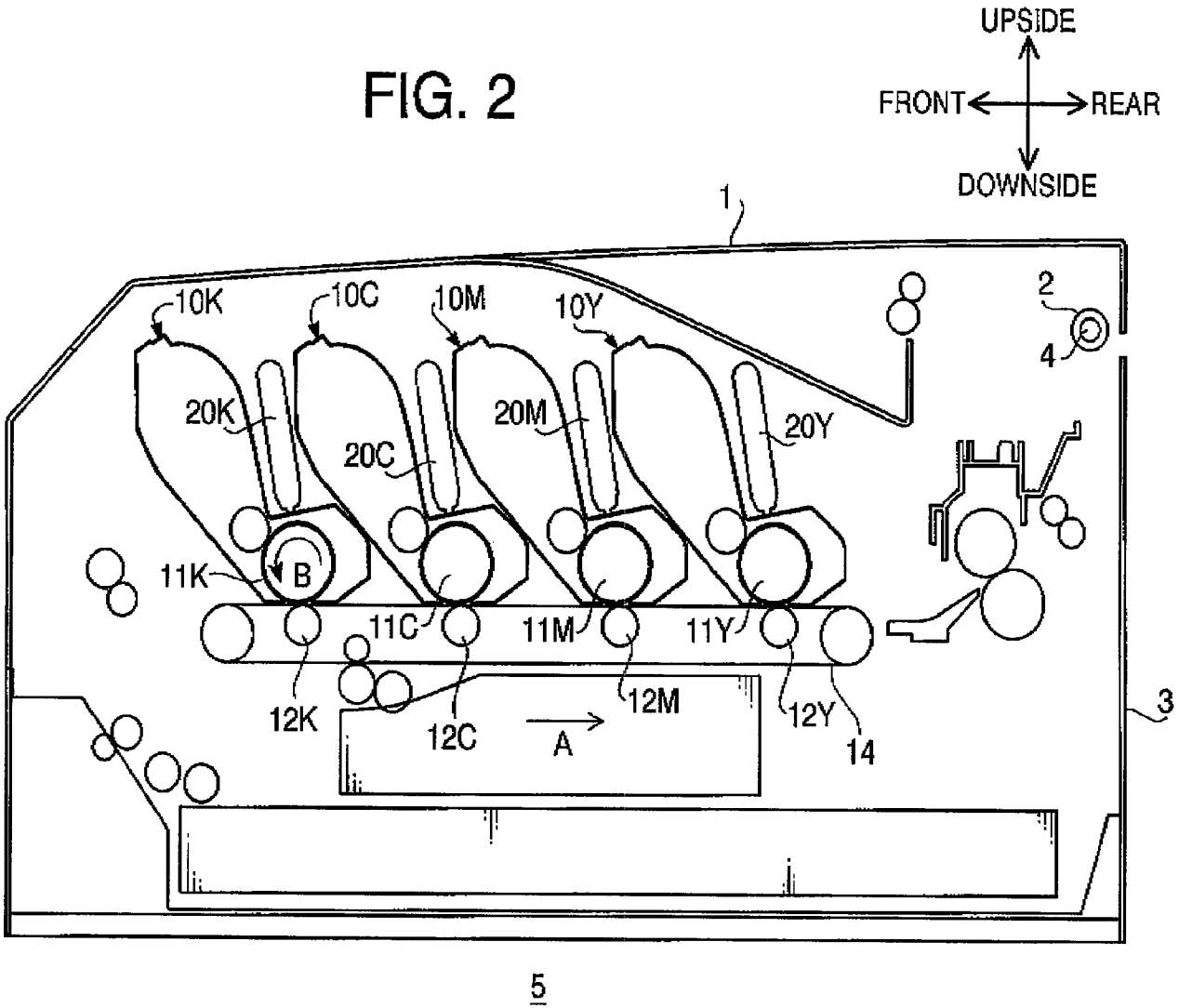

FIG. 2 schematically shows the image forming device 5 in a state where the upper case 1 is shut so as to close the mechanical unit 3 from the state shown in FIG. 1 where the upper case 1 is open. When the upper case 1 is closed, a below-mentioned LED heads 32 provided at a distal end of each of the LED units 20K, 20C, 20M, and 20Y is placed close to a circumferential surface of a corresponding one of the photoconductive bodies 11K, 11C, 11M, and 11Y, so that the circumferential surface of the corresponding photoconductive body 11K, 11C, 11M, or 11Y can be exposed. Each of the photoconductive bodies 11K, 11C, 11M, and 11Y is rotatable in the arrow B direction, and the front side and rear side with respect to an exposure position on the circumferential surface thereof represent a downstream side where the exposure has been done and upstream side where the exposure has not been done, respectively. It is noted that the exposure is performed linearly along a main scanning direction which is perpendicular to the arrow B direction on the circumferential surface of each of the photoconductive bodies 11K, 11C, 11M, and 11Y. It is also noted that the photoconductive bodies 11K, 11C, 11M, and 11Y which are drum-shaped in the present embodiment, for example, may be belt-shaped.

Figure 3:
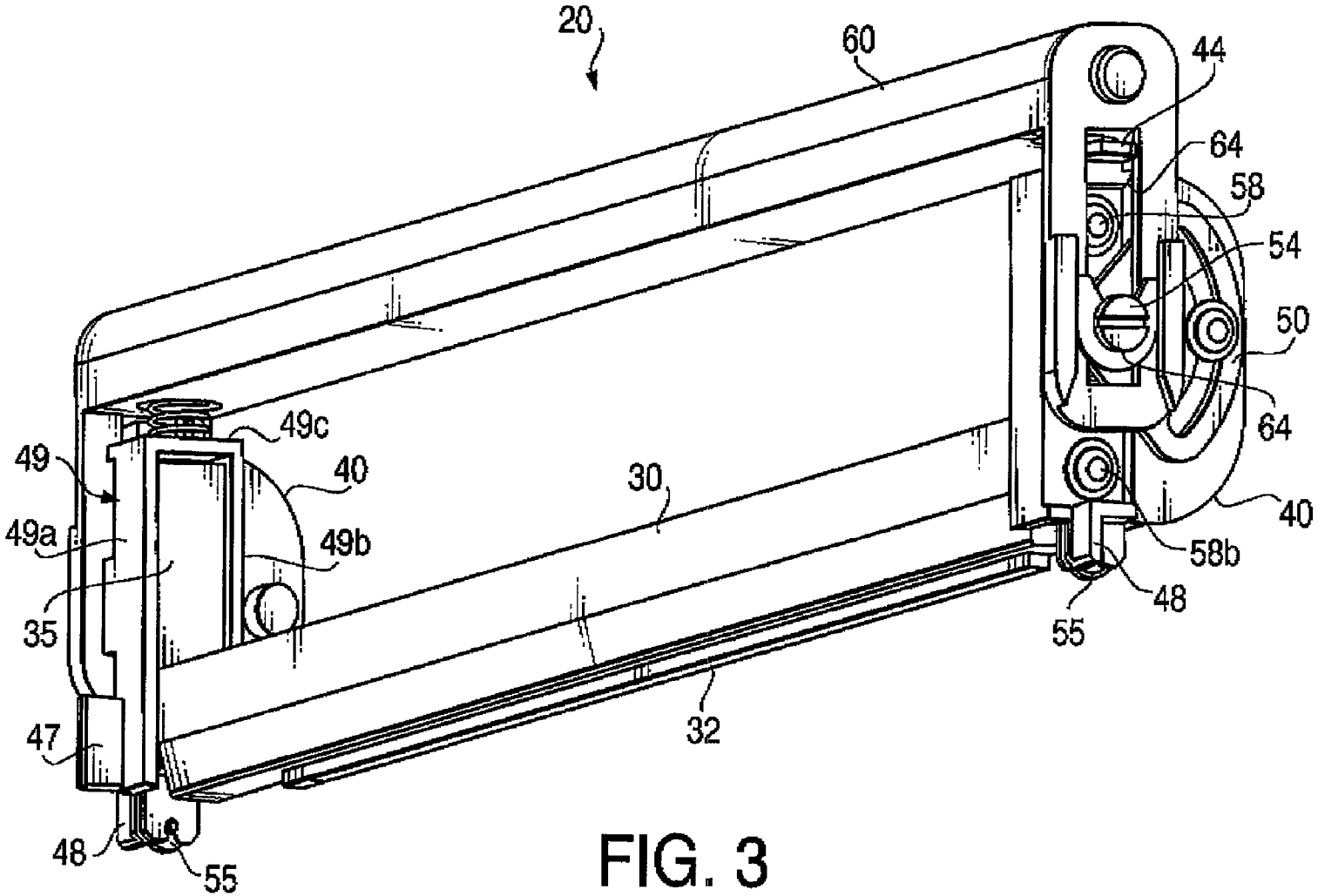
FIG. 3 is a perspective view schematically showing an entire configuration of each LED unit in the first embodiment according to one or more aspects of the present invention.

FIG. 3 is a perspective view schematically showing an entire configuration of any of the LED units 20K, 20C, 20M, and 20Y, each of which has the same configuration and hereinafter may be referred to as an "SLED unit 20" to denote a representative one of the all units. In FIG. 3, a left side and right side along a longitudinal direction of the LED unit 20 correspond to the left side and right side of the image forming device 5, respectively. A supporting body 30 having a LED head 32 is attached to an LED holder 40. A connection member 50 connects the LED holder 40 with the supporting member 30. The supporting body 30, LED holder 40, and connection member 50, which are integrated in this manner, are supported by an LED supporting member 60. The LED unit 20 is configured as an integrated unit with the aforementioned components. Details about each of the components will be described below.

Figure 4:
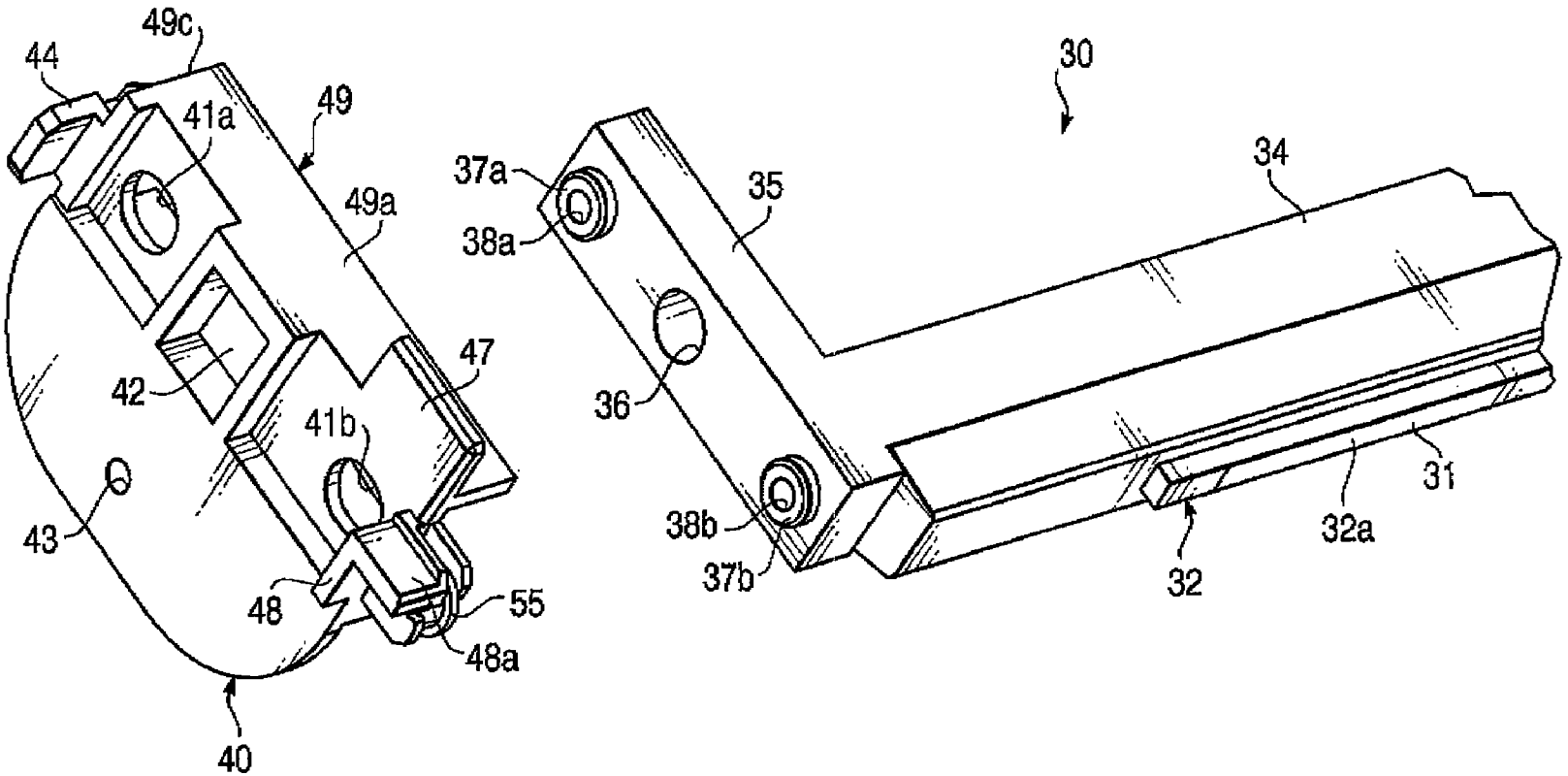
FIG. 4 is a perspective view schematically showing an LED holder and supporting body provided with an LED head in the first embodiment according to one or more aspects of the present invention.

FIG. 4 is a perspective view schematically showing the LED holder 40 and supporting body 30 provided with the LED head 32. It is noted that, in FIGS. 4 to 6, an oblique left downside and oblique right upside correspond to the left side and right side of the image forming device 5, respectively. Additionally, in FIGS. 4 to 6, a right portion of the supporting body 30 from the vicinity of the center thereof is not shown. This is because the supporting body 30 is configured to be substantially bilaterally-symmetrical with exceptional portions which may particularly be described.

The supporting body 30 includes a longitudinal supporting body 34 that extends along a right-to-left direction of the image forming device 5 (main scanning direction of the exposure), and side supporting body 35 that is integrally or separately provided at each end of the longitudinal supporting body 34. The LED head 32 is provided beneath the longitudinal supporting body 34. The LED head 32 is configured with an LED array 31 linearly aligned along the main scanning direction and a SELFOC® Lens Array (not shown) as a single unit. An exposure surface 32*a*, which is directed in a direction in which the light is emitted by the LED head 32, is located so as to face the photoconductive body 11 when the upper case 1 is closed.

The side supporting body 35 is provided with bosses 37*a* and 37*b* protruding outward and a circular recess 36. The bosses 37*a* and 37*b* are provided with respective screw holes 38*a* and 38*b* in which below-mentioned screws 58*a* and 58*b* are screwed, respectively.

The LED holder 40 includes oval holes 41*a* and 41*b*, a square hole 42 provided between the oval holes 41*a* and 41*b*, and a screw hole 43 for fixing with a below-mentioned screw 58*c*, each of which holes are formed as through holes. Further, the LED holder 40 is provided with a holder side portion 49 at the right side thereof, which includes a holder front portion 49*a* protruding rightward, a holder rear portion 49*b* protruding rightward so as to face the holder front portion 49*a*, and a holder upper portion 49*c* joining respective upper portions of the holder front portion 49*a* and holder rear portion 49*b* (see FIG. 3).

Additionally, at an end of the main scanning direction, the LED holder 40 includes a vertically-long projection 47 provided at a lower portion thereof so as to vertically extend, protruded portion 48, and contact face 48*a* provided to the protruded portion 48. Further, the LED holder 40 includes a roller 55 rotatably provided close to the protruded portion 48 so as to contact the photoconductive body 11.

Figure 5:
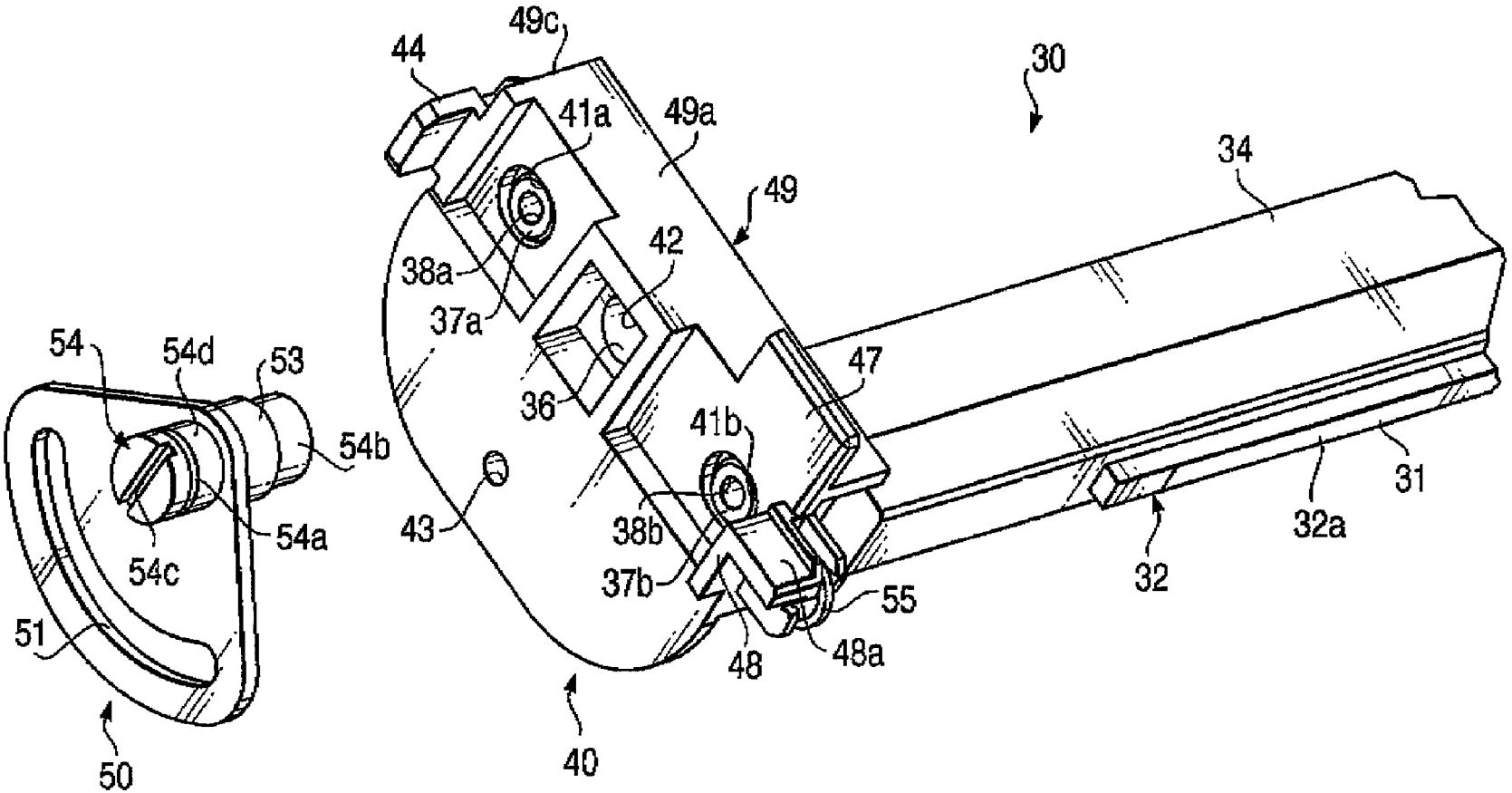
FIG. 5 is a perspective view schematically showing the supporting body with the LED holder attached thereto, and a connection member for connecting the LED holder with the supporting body in the first embodiment according to one or more aspects of the present invention.

FIG. 5 is a perspective view schematically showing the supporting body 30 with the LED holder 40 attached thereto, and a connection member 50 for connecting the LED holder 40 with the supporting body 30.

The holder side portion 49 is provided so as to pinch the side supporting body 35 in a front-to-rear direction (see FIG. 3). The bosses 37*a* and 37*b* provided to the side supporting body 35 are fitted into the oval holes 41*a* and 41*b* provided to the LED holder 40, respectively. The oval holes 41*a* and 41*b* are formed in a shape of a gold oval coin to generate a clearance each between the oval hole 41*a* and boss 37*a* and between the oval hole 41*b* and boss 37*b*. Hence, the LED holder 40 is provided to be slightly shifted along the vertical direction with respect to the supporting body 30.

The connection member 50 includes a bending hole 51 that bends in a C-shape and a cylindrical projection 54. The cylindrical projection 54 is provided with a first protruded portion 54*d* protruding outward and a second protruded portion 54*b* protruding inward. The first protruded portion 54*d* is formed with a groove 54*a* around which a below-mentioned stop ring 67 is fitted and a slot 54*c* into which a flat-blade screwdriver is inserted. The second protruded portion 54*b* includes an eccentric cam 53.

Figure 6:
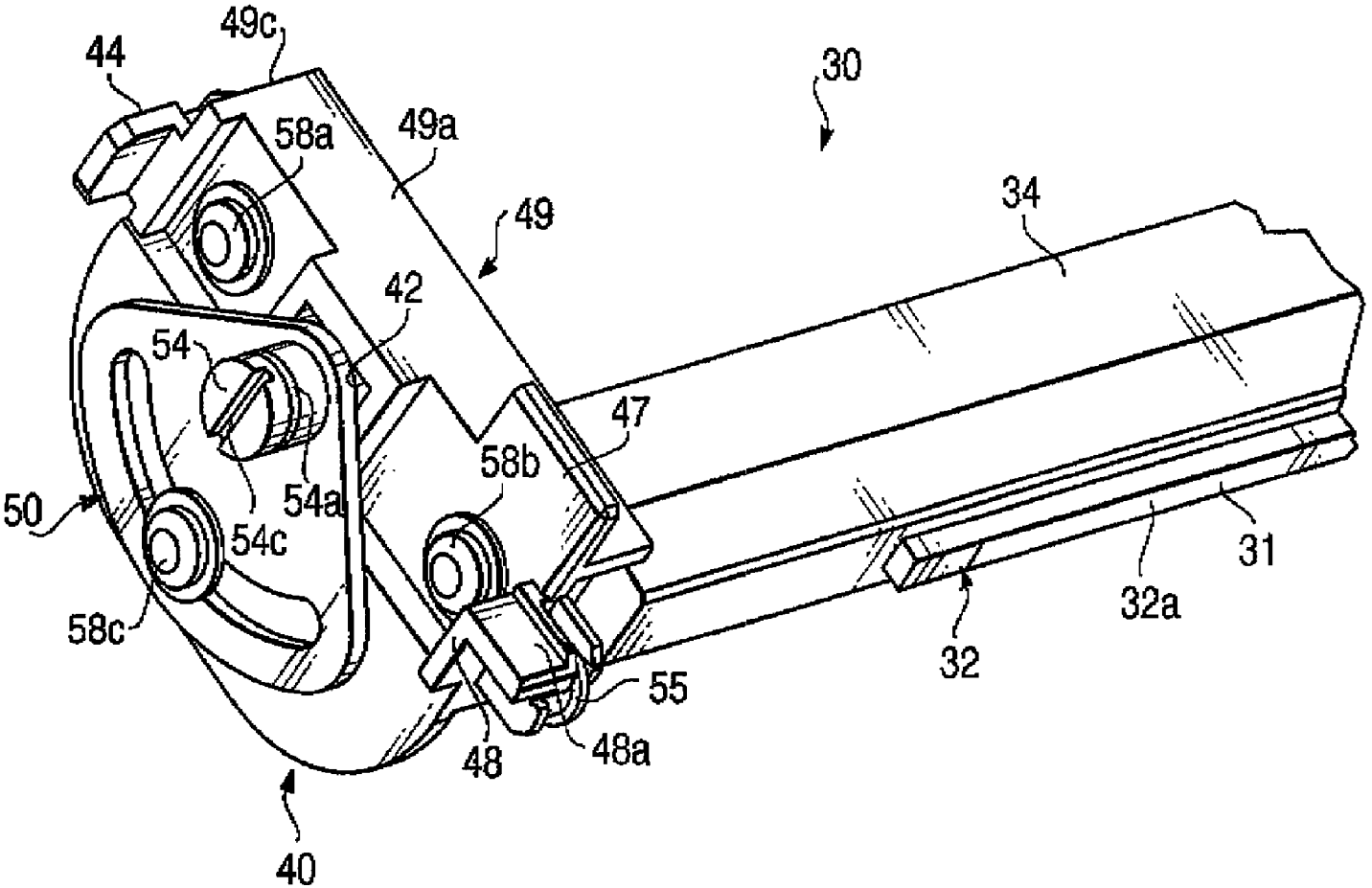
FIG. 6 is a perspective view schematically showing the supporting body and LED holder which are connected by having the connection member attached thereto in the first embodiment according to one or more aspects of the present invention.
Figure 7A:
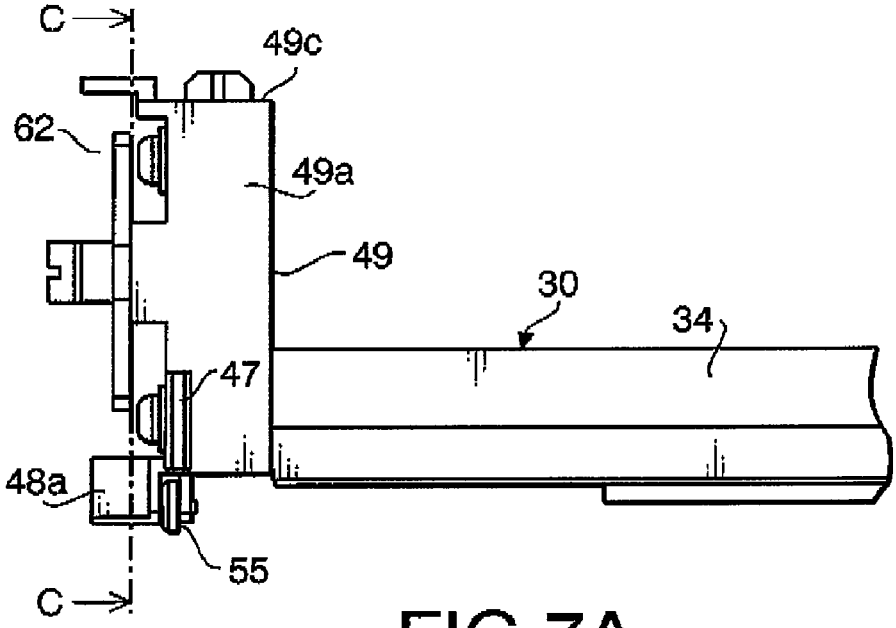
FIG. 7A is a front view of the configuration shown in FIG. 6 in the first embodiment according to one or more aspects of the present invention.
Figure 7B:
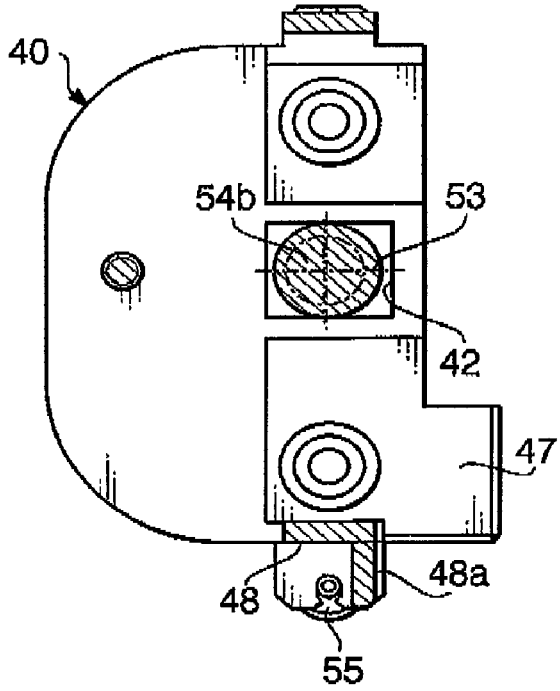
FIG. 7B is a cross-sectional view of the configuration shown in FIG. 7A along a C-C line in the first embodiment according to one or more aspects of the present invention.

FIG. 6 is a perspective view schematically showing the supporting body 30 and LED holder 40 which are connected by having the connection member 50 attached thereto. Further, FIG. 7A is a front view of the configuration shown in FIG. 6. FIG. 7B is a cross-sectional view of the configuration shown in FIG. 7A along a C-C line. Hereinafter, operations to be performed from the state shown in FIG. 5 to that shown in FIG. 6 will be described.

Firstly, the side supporting body 35 and LED holder 40 are provisionally fixed to each other with the screws 58*a* and 58*b* being screwed into the screw holes 38*a* and 38*b* through the oval holes 41*a* and 41*b*, respectively. Subsequently, the second protruded portion 54*b* is fitted into the circular recess 36 of the side supporting body 35, and the eccentric cam 53 is fitted into the square hole 42 of the LED holder 40.

It is noted that the first protruded portion 54*d* and second protruded portion 54*b* have an identical circular center. Further, as shown in FIG. 7B, the second protruded portion 54*b* is drawn by a chain double-dashed line, and the eccentric cam 53 is drawn by a solid line. As understood from FIG. 7B, the eccentric cam 53 has a different circular center from that of the first protruded portion 54*d* and second protruded portion 54*b*. The side supporting body 35, LED holder 40, and connection member 50 can be positioned in the vertical direction with respect to each other with the flat-blade screwdriver being inserted into the slot 54*c* of the cylindrical projection 54 and rotated.

Next, the screw hole 43 and bending hole 51 are fixed with a screw 58*c*. Finally, the screws 58*a* and 58*b* that have earlier been provisionally fixed are tightly fastened, and the side supporting body 35, LED holder 40, and connection member 50 are fixed to each other. Thereby, even though the components are fixed to each other with some positional errors, the errors can be overcome through final adjustment in assembling. The exposure surface 32*a* of the LED head 32 has to be strictly controlled on the order of several tens of micrometers. The aforementioned configuration and assembling manner can meet such a strict requirement.

Figure 8:
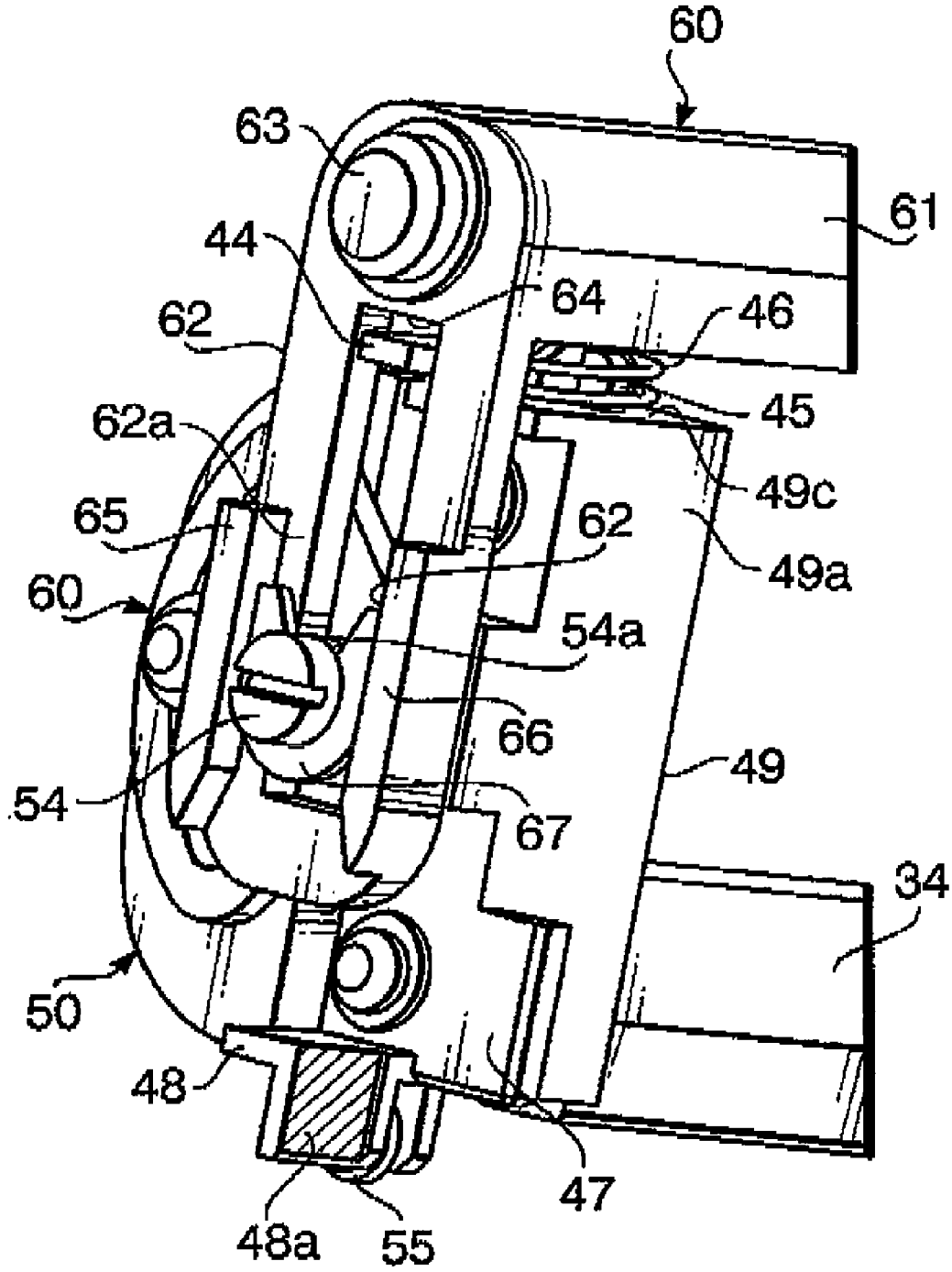
FIG. 8 is a perspective view schematically showing the LED supporting member attached to an integrated unit of the supporting body and LED holder with the connection member attached thereto in the first embodiment according to one or more aspects of the present invention.

FIG. 8 is a perspective view schematically showing the LED supporting member 60 attached to an integrated unit of the supporting body 30 and LED holder 40 with the connection member 50 attached thereto. Further, in FIG. 8, an oblique upper left side and oblique lower right side of the figure correspond to the left side and right side of the image forming device 5. It is noted that the roller 55 shown in FIG. 8 is in a state where the roller 55 contacts the photoconductive 11 (not shown).

The LED supporting member 60 has a longitudinal supporting portion 61 provided along the main scanning direction of the photoconductive body 11. In addition, a side supporting portion 62 is provided at a side face of the longitudinal supporting portion 61. There is provided at an upper side of the side supporting portion 62, a circular boss 63 to fit into a hole (not shown) provided to the upper case 1. Further, a rectangular hole 64 is provided in the vicinity of a center of the side supporting portion 62.

The first protruded portion 54*d* of the cylindrical projection 54 provided to the connection member 50 is fitted into the rectangular hole 64 of the side supporting portion 62. The cylindrical projection 54 is configured to have a diameter smaller than a length in a width (short side) direction of the rectangular hole 64. Thus, the cylindrical projection 54 can slightly be shifted in the width direction of the rectangular hole 64. Further, vertical movements of the supporting body 30 and LED holder 40 that are connected via the connection member 50 are restricted by a locking portion 44 extending from the LED holder 40 for the upward movement, and by the cylindrical projection 54 for the downward movement. Furthermore, the locking portion 44 restricts the movement of the supporting body 30 and LED holder 40 along the front-to-rear direction as well.

A stopper ring 67 is fitted around the groove 54*a* along regulating portions 65 and 66 provided at both sides of the rectangular hole 64, from beneath the side supporting portion 62. Thereby, the supporting body 30 and LED holder 40 that are connected via the connection member 50 are held so as not to be dropped off the LED supporting member 60 with the stopper ring 67 contacting stopper portions 62*a* and 62*b* of the side supporting portion 62. Namely, by fitting the stopper ring 67 around the groove 54*a*, the movement of the LED head 32 along the main scanning direction of the photoconductive body 11 is restricted.

Further, a clearance is provided between the stopper ring 67 and any of the regulating portions 65 and 66. Hence, the first protruded portion 54*d* of the cylindrical projection 54 can somewhat be shifted within the rectangular hole 64 in any of the front-to-rear, vertical, and right-to-left directions. The regulating portions 65 and 66 are provided such that the stopper ring 67 is not easily dropped off.

Figure 9:
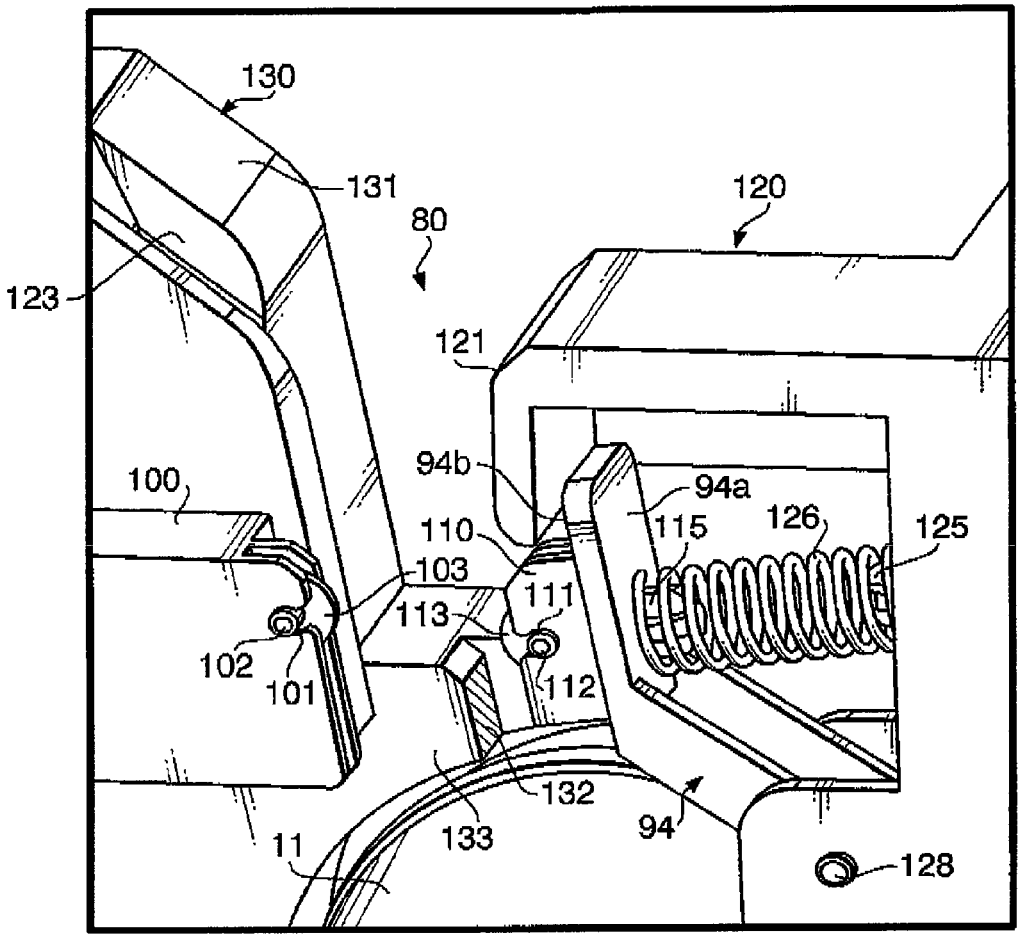
FIG. 9 shows a guide portion of the mechanical unit for guiding the LED unit in the first embodiment according to one or more aspects of the present invention.

FIG. 9 shows a guide portion 80 of the mechanical unit 3 for guiding the LED unit 20. A front mechanical unit 130, which is provided as part of the mechanical unit 3 at a front side with respect to the guide portion 80 includes a guide surface 131 to guide the LED unit 20, guide groove 123 into which the vertically-long projection 47 is inserted, first contact member 103 formed as a roller, and second contact member 133. In addition, a first contact member shaft 102 as a rotation shaft of the first contact member 103 is loosely and rotatably fitted into a first contact member bearing 101 of a first contact member supporting portion 100 provided to the front mechanical unit 130.

On the other hand, a rear mechanical unit 120, which is provided as part of the mechanical unit 3 at a rear side with respect to the guide portion 80, includes a guide surface 121 to guide the LED unit 20, and third contact member 113 formed as a roller. The third contact member 113, which is provided opposite the first contact member 103 with respect to the guide portion 80 so as to face the first contact member 103, is loosely and rotatably fitted into a third contact member bearing 111 of a third contact member supporting portion 110 in the same manner as the first contact member 103.

The third contact member supporting portion 110 is provided at an arm 94 extending from the rear mechanical unit 120. Further, the arm 94 is provided rotatably around an arm shaft 128. The arm 94 includes a contact regulating surface 94*b* at a side facing the third contact member 113, and a spring biasing surface 94*a* at the opposite side. On the spring biasing surface 94*a*, there is provided a cross-shaped spring supporting member 115. Further, another spring supporting member 125 is provided to the rear mechanical unit 120 so as to face the spring supporting member 115. A biasing spring 126 is provided between the spring supporting members 115 and 125. The third contact member 113 is biased by the biasing spring 126 toward the first contact member 103.

It is noted that FIG. 9 shows the guide portion 80 in a state where the upper case 1 is closed and the LED unit 20 is guided (the LED unit 20 is not shown therein). When the upper case 1 is opened, the contact regulating surface 94*b* is shifted toward the first contact member 103 by the biasing spring 126 and stopped in a position where the contact regulating surface 94*b* contacts an end of the guide surface 121.

Figure 10:
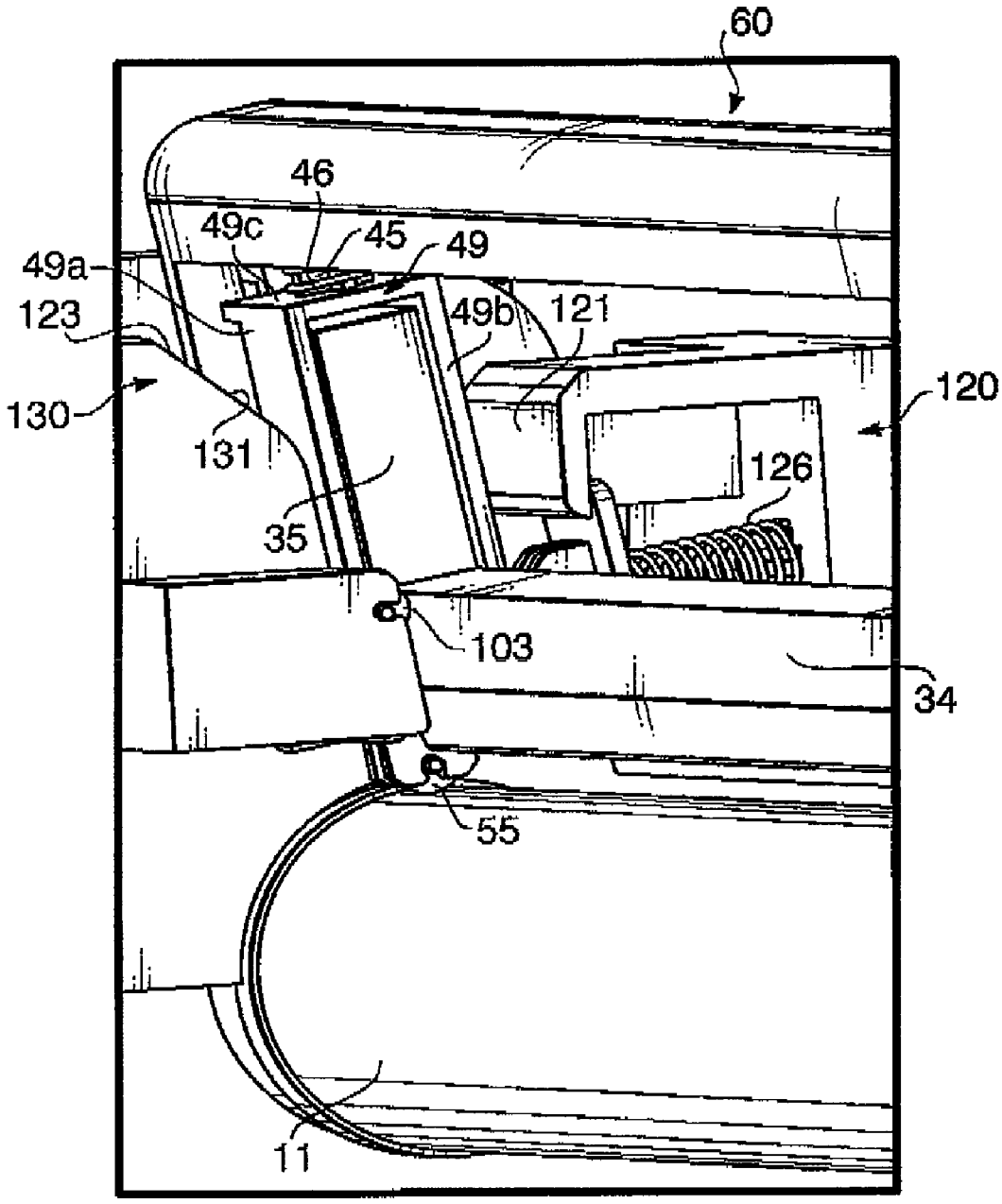
FIG. 10 shows the LED unit in a state positioned with respect to the mechanical unit through the guide portion in the first embodiment according to one or more aspects of the present invention.
Figure 11:
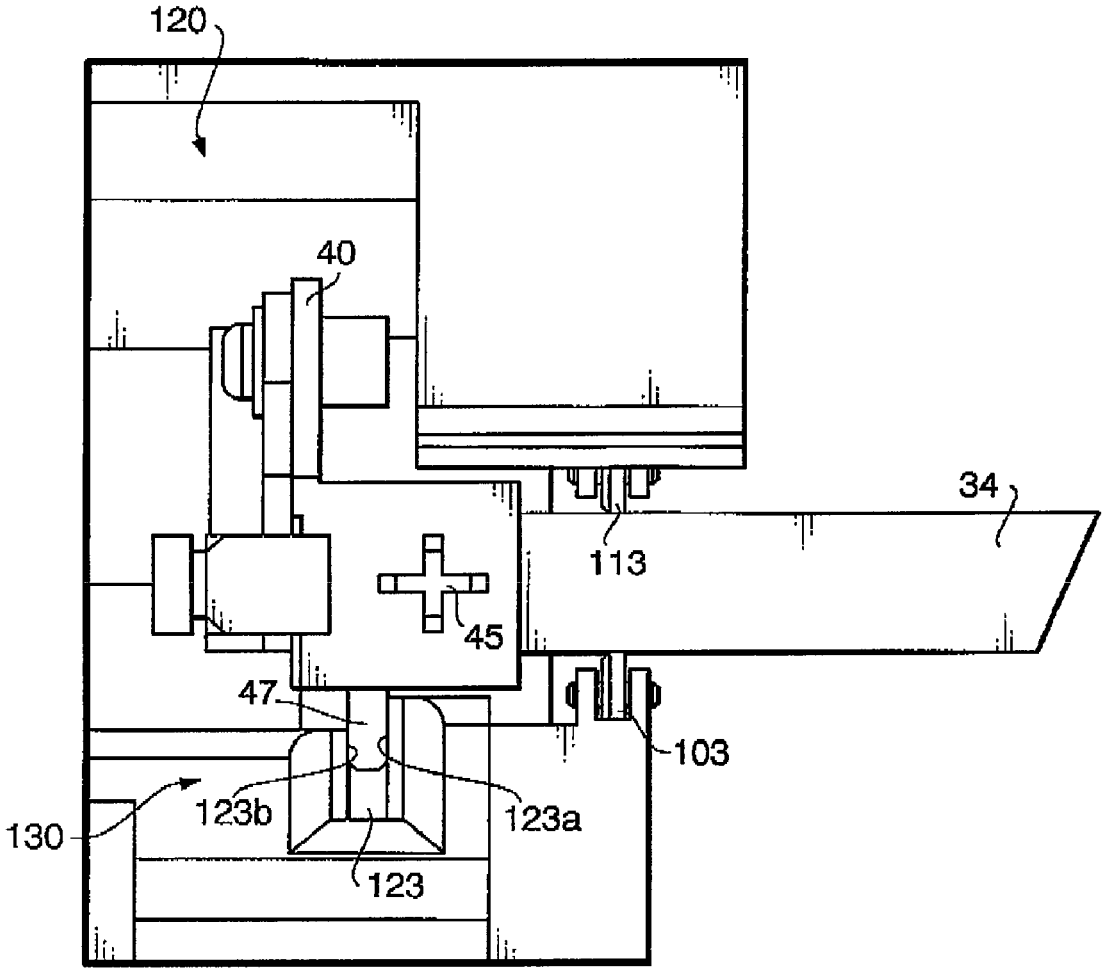
FIG. 11 is a top view of the configuration shown in FIG. 10 in the first embodiment according to one or more aspects of the present invention.

FIG. 10 shows the LED unit 20 in a state positioned with respect to the mechanical unit 3 through the guide portion 80 in the case where the upper case 1 is closed. FIG. 11 is a top view of the configuration shown in FIG. 10. It is noted that the upper case 1, LED supporting member 60, and a spring 46 are not shown in FIG. 11 for the sake of easy and simple explanation.

The holder front portion 49*a* and the holder rear portion 49*b* located to face the holder front portion 49*a* are guided by the guide surfaces 131 and 121, respectively, inserted into the guide portion 80, and finally guided between the first contact member 103 and third contact member 113 to contact the first contact member 103 and third contact member 113, respectively. As described above, the LED supporting member 60 is fixed to the upper case 1. However, since the supporting body 30 and LED holder 40 integrated as a single unit with the connection member 50 is supported rotatably with respect to the LED supporting member 60, they can be inserted along the guide surfaces 131 and 121.

A cross-shaped spring locking member 45 is provided at a holder upper portion 49*c* of the LED holder 40, and the spring 46 is fitted around the spring locking member 45 (see FIG. 8). Hence, although the roller 55 contacts the photoconductive body 11 even just before the upper case 1 is completely closed, the LED holder 40 which is biased by the spring 46 can vertically be positioned without the roller 55 having to be forcedly pressed against the photoconductive body 11.

Additionally, the positioning of the LED holder 40 in the right-to-left direction is regulated by the vertically-long projection 47 as shown in FIG. 11. At the same time as the upper case 1 is closed, the longitudinal supporting body 34 is guided by the first contact member 103 and third contact member 113, and the vertically-long projection 47 provided at the left side of the LED unit 20 is guided by the guide groove 123. The vertically-long projection 47 contacts either one of vertically-long surfaces 123*a* and 123*b* of the guide groove 123 to regulate the movement of the LED head 20 in the main scanning direction. It is noted that the vertically-long projection 47 is provided only at the left side of the LED unit. The reason why the LED unit 20 is provided with the vertically-long projection 47 at only one of the right side and left side thereof is that the image forming device 5 is thermally expanded while being driven.

Figure 12:
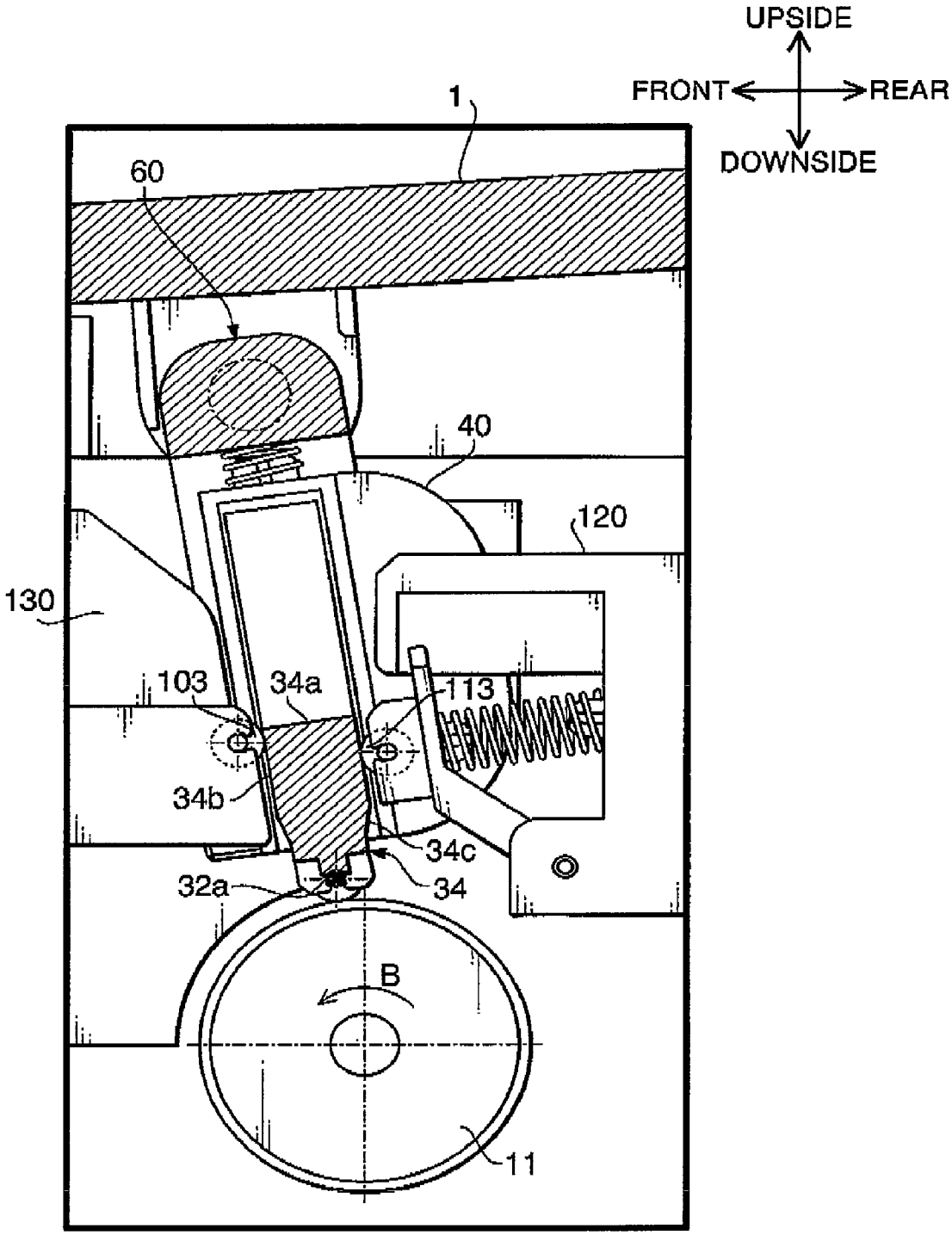
FIG. 12 is a cross-section, viewed from a right side, of the LED unit positioned with respect to the mechanical unit in the first embodiment according to one or more aspects of the present invention.

FIG. 12 is a cross-section, viewed from the right side, of the LED unit 20 positioned with respect to the mechanical unit 3. The longitudinal supporting body 34 of the supporting body 30 has an opposed surface 34*a* facing the exposure surface 32*a*, a first side surface 34*b* that is parallel to the main scanning direction of the exposure surface 32*a* and connects the exposure surface 32*a* with the opposed surface 34*a*, and a second side surface 34*c* located opposite the first side surface 34*b*.

The first and second contact members 103 and 133 are provided at a side of the first side surface 34*b*. The third contact member 113 is provide at a side of the second side surface 34*c*. Namely, the first and second contact members 103 and 133 contact the LED unit 20 from the front side of the image forming device 5 (i.e., the side of the first side surface 34*b*). In addition, the third contact member 113 contacts the LED unit 20 from the rear side of the image forming device 5 (i.e., the side of the second side surface 34*c*).

Figure 13:
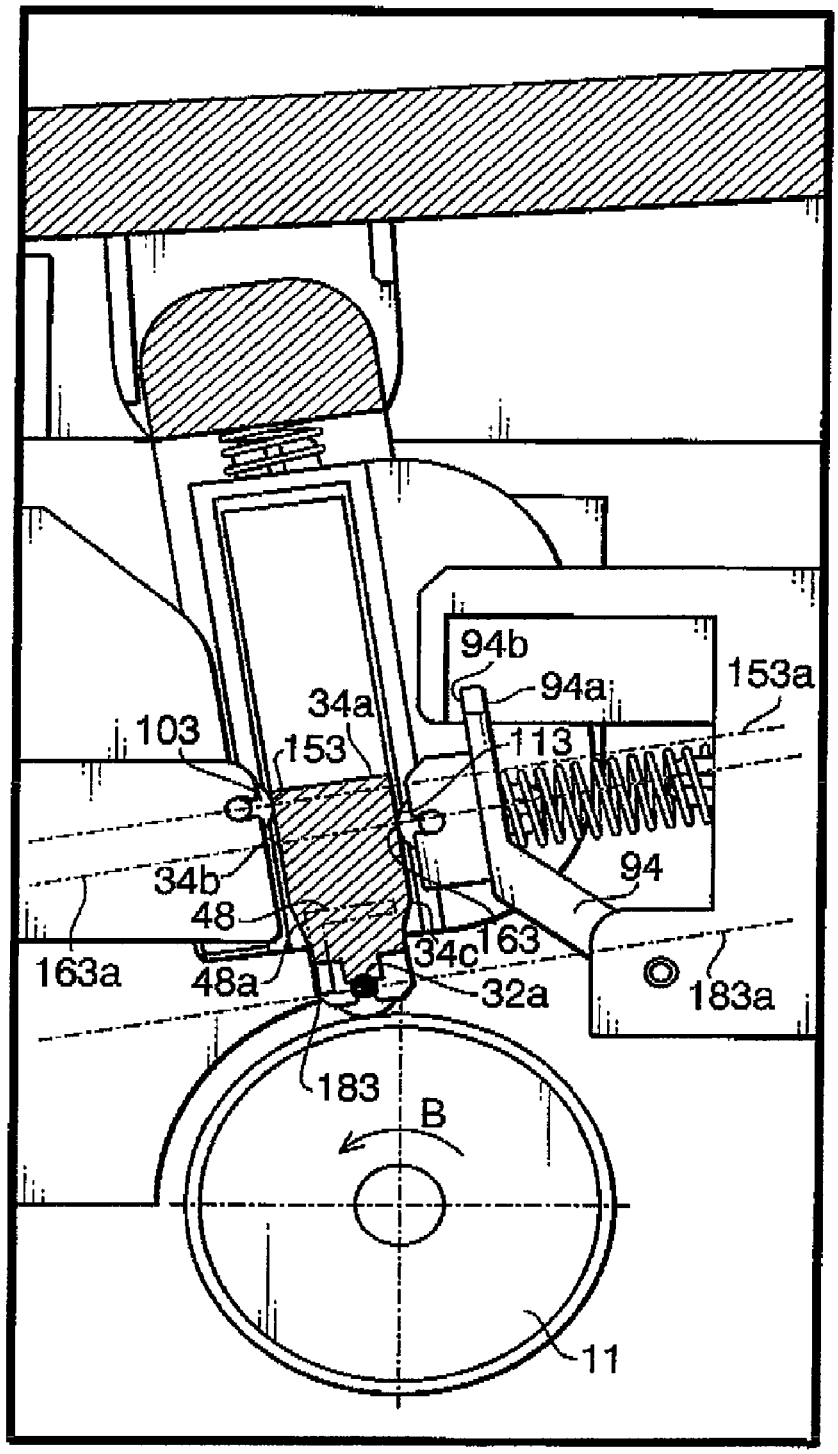
FIG. 13 shows a first contact point between a first contact member and a longitudinal supporting body, second contact point between a second contact member and the longitudinal supporting body, and third contact point between a third contact member and the longitudinal supporting body in the first embodiment according to one or more aspects of the present invention.

In FIG. 13, the protruded portion 48 is indicated in addition to the structure shown in FIG. 12. At the left side of the longitudinal supporting body 34 (the back side of the figure), the protruded portion 48 indicated by a chain double-dashed line is provided to the LED holder 40. The contact face 48*a* of the protruded portion 48 faces and contacts a contact flat surface 132 (see FIG. 14) of the second contact member 133.

On the cross-section shown in FIG. 13, a first contact point 153 represents a position in which the first contact member 103 contacts the first side surface 34*b* of the longitudinal supporting body 34. In addition, a third contact point 163 represents a position in which the third contact member 113 contacts the second side surface 34*c* of the longitudinal supporting body 34. Further, although the contact flat surface 132 of the second contact member 133 establishes surface-by-surface contact with the contact face 48*a* of the protruded portion 48, a second contact point 183 represented in the present embodiment is located in the lowest position of the contact face 48*a*.

A plane, including the third contact point 163, which is parallel to the main scanning direction of the exposure and a direction of a biasing force of the third contact member 113 against the second side surface 34*c*, is defined as a third standard plane 163*a*. In addition, a plane, including the first contact point 153, which is parallel to the third standard plane 163*a*, is defined as a first standard plane 153*a*. Further, a plane, including the second contact point 183, which is parallel to the third standard plane 163*a*, is defined as a second standard plane 183*a*. The third contact point 163 is placed between the first and second standard planes 153*a* and 183*a* to contact the second side surface 34*c*. Thus, by locating the third contact point 163 between the first and second standard planes 153*a* and 183*a*, the longitudinal supporting body 34 can maintain a stable posture.

Further, the photoconductive body 11 is rotated (endlessly moved) in the arrow B direction. Therefore, a force is applied to the roller 55 contacting the photoconductive body 11 so as to move forward the roller 55 while the photoconductive body 11 is being rotated. Consequently, such a force as to move forward the longitudinal supporting body 34 is applied thereto. However, the longitudinal supporting body 34 is supported in both of the first and second contact points 153 and 183 provided at the downstream side (front side) in the rotational direction of the photoconductive body 11, and thereby can maintain a stable posture.

Figure 14:
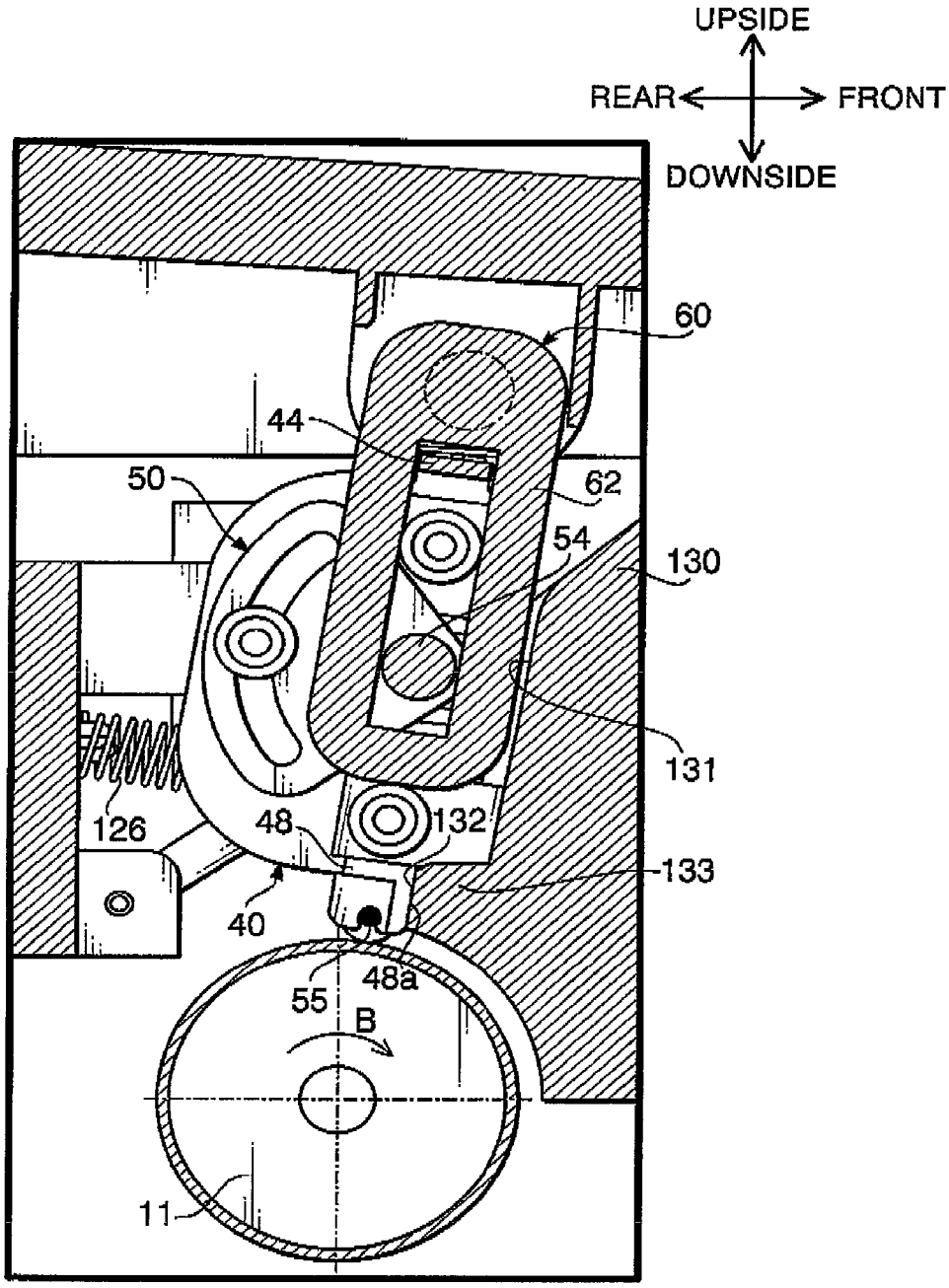
FIG. 14 is a cross-section, viewed from a left side, of the LED unit positioned with respect to the mechanical unit in the first embodiment according to one or more aspects of the present invention.

Further, as shown in FIG. 14, owing to the rotation of the photoconductive body 11, the contact face 48*a* of the protruded portion 48 comes into contact with the contact flat surface 132 of the second contact member 133. The second contact member 133 provided in the vicinity of the photoconductive body 11 is more strongly affected by the rotating photoconductive body 11. Therefore, the LED unit 20 can be put into a more stable state by positioning the contact face 48*a* and the contact flat surface 132 relatively to each other through the surface-to-surface contact therebetween and placing a rotational center of the roller 55 above the second standard plane 183*a* including the second contact point 183.

In the present embodiment, the first and third contact members 103 and 113 contact the first and second side surfaces 34*b* and 34*c*, respectively. Further, the contact face 48*a* of the protruded portion 48, which is provided to the LED holder 40, contacts the contact flat surface 132. However, the present invention is not limited to the aforementioned configuration. Specifically, different contacts may be established from both the side of the first side surface 34*b* (the front side of the mechanical unit 3) and the side of the second side surface 34*c* (the rear side of the mechanical unit 3). For example, below-mentioned embodiments may be possible.

FIGS. 15A to 15F show other embodiments according to aspects of the present invention. It is noted that, in each of FIGS. 15A to 15F, a left side and right side of the figure represent the front side and rear side of the image forming device 5, respectively.

Figure 15B:
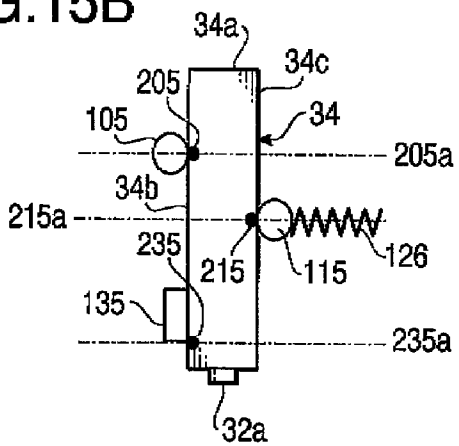
FIG. 15B shows a first contact point between a first contact member and the longitudinal supporting body, second contact point between a second contact member and the longitudinal supporting body, and third contact point between a third contact member and the longitudinal supporting body in a third embodiment according to one or more aspects of the present invention.
Figure 15A:
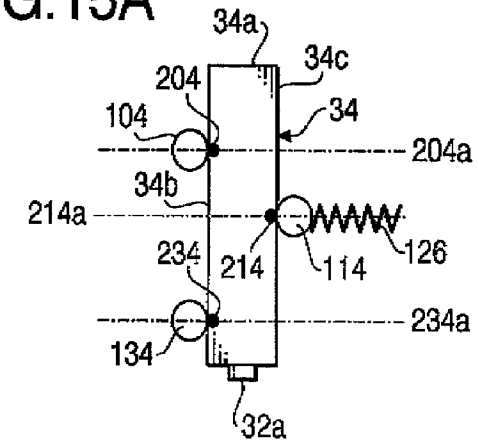
FIG. 15A shows a first contact point between a first contact member and the longitudinal supporting body, second contact point between a second contact member and the longitudinal supporting body, and third contact point between a third contact member and the longitudinal supporting body in a second embodiment according to one or more aspects of the present invention.

FIG. 15A schematically shows a second embodiment in which each of first, second, and third contact members 104, 134, and 114 is configured with a roller. A point in which the first contact member 104 contacts the first side surface 34*b* is a first contact point 204. In addition, a point in which the second contact member 134 contacts the first side surface 34*b* is a second contact point 234. Further, a point in which the third contact member 114 contacts the second side surface 34*c* is a third contact point 214.

A plane, including the third contact point 214, which is parallel to the main scanning direction of the exposure and a direction of a biasing force of the third contact member 114 against the second side surface 34*c*, is defined as a third standard plane 214*a*. In addition, a plane, including the first contact point 204, which is parallel to the third standard plane 214*a*, is defined as a first standard plane 204*a*. Further, a plane, including the second contact point 234, which is parallel to the third standard plane 214*a*, is defined as a second standard plane 234*a*. The third contact point 214 is placed between the first and second standard planes 204*a* and 234*a* to contact the second side surface 34*c*.

FIG. 15B schematically shows a third embodiment in which each of a first contact member 105 and third contact member 115 is configured with a roller, and a second contact member 135 is configured with a member having a flat surface. A point in which the first contact member 105 contacts the first side surface 34*b* is a first contact point 205. In addition, a point in which the second contact member 135 contacts the first side surface 34*b* is a second contact point 235. Further, a point in which the third contact member 115 contacts the second side surface 34*c* is a third contact point 215. Further, although the flat surface of the second contact member 135 establishes surface-by-surface contact with the first side surface 34*b*, the second contact point 235 represented in the present embodiment is located in the lowest position of the plate-shaped second contact member 135.

A plane, including the third contact point 215, which is parallel to the main scanning direction of the exposure and a direction of a biasing force of the third contact member 115 against the second side surface 34*c*, is defined as a third standard plane 215*a*. In addition, a plane, including the first contact point 205, which is parallel to the third standard plane 215*a*, is defined as a first standard plane 205*a*. Further, a plane, including the second contact point 235, which is parallel to the third standard plane 215*a*, is defined as a second standard plane 235*a*. The third contact point 215 is placed between the first and second standard planes 205*a* and 235*a* to contact the second side surface 34*c*.

Figure 15D:
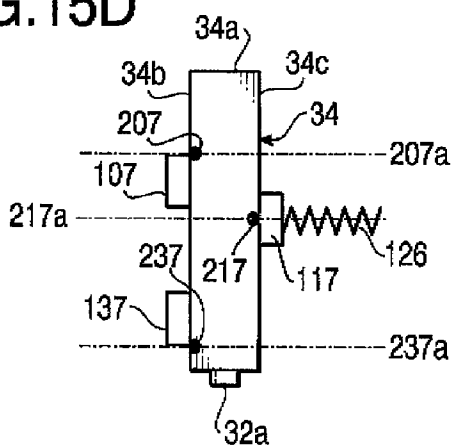
FIG. 15D shows a first contact point between a first contact member and the longitudinal supporting body, second contact point between a second contact member and the longitudinal supporting body, and third contact point between a third contact member and the longitudinal supporting body in a fifth embodiment according to one or more aspects of the present invention.
Figure 15C:
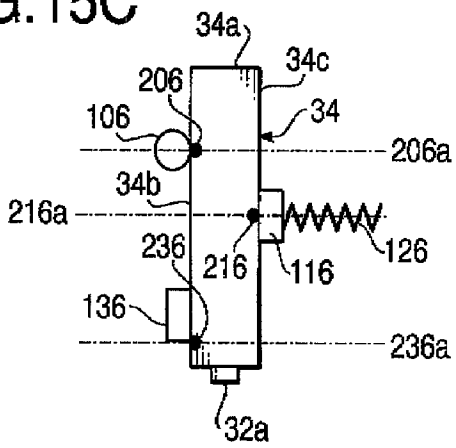
FIG. 15C shows a first contact point between a first contact member and the longitudinal supporting body, second contact point between a second contact member and the longitudinal supporting body, and third contact point between a third contact member and the longitudinal supporting body in a fourth embodiment according to one or more aspects of the present invention.

FIG. 15C schematically shows a fourth embodiment in which a first contact member 106 is configured with a roller, and each of a second contact member 136 and third contact member 116 is configured with a member having a flat surface. A point in which the first contact member 106 contacts the first side surface 34*b* is a first contact point 206. In addition, a point in which the second contact member 136 contacts the first side surface 34*b* is a second contact point 236. Further, a point in which the third contact member 116 contacts the second side surface 34*c* is a third contact point 216. Further, although each flat surface of the second and third contact members 136 and 116 establishes surface-by-surface contact with the first side surface 34*b*, the second contact point 236 represented in the present embodiment is located in the lowest position of the plate-shaped second contact member 136, and the third contact point 216 represented in the present embodiment is located in a center of the plate-shaped third contact member 116.

A plane, including the third contact point 216, which is parallel to the main scanning direction of the exposure and a direction of a biasing force of the third contact member 116 against the second side surface 34*c*, is defined as a third standard plane 216*a*. In addition, a plane, including the first contact point 206, which is parallel to the third standard plane 216*a*, is defined as a first standard plane 206*a*. Further, a plane, including the second contact point 236, which is parallel to the third standard plane 216*a*, is defined as a second standard plane 236*a*. The third contact point 216 is placed between the first and second standard planes 206*a* and 236*a* to contact the second side surface 34*c*.

FIG. 15D schematically shows a fifth embodiment in which each of first, second, and third contact members 107, 137, and 117 is configured with a member having a flat surface. A point in which the first contact member 107 contacts the first side surface 34*b* is a first contact point 207. In addition, a point in which the second contact member 137 contacts the first side surface 34*b* is a second contact point 237. Further, a point in which the third contact member 117 contacts the second side surface 34*c* is a third contact point 217. Each flat surface of the first second, and third contact members 107, 137, and 117 establishes surface-by-surface contact with the longitudinal supporting body 34. However, the first contact point 207 represented in the present embodiment is located in the uppermost position of the plate-shaped first contact member 107, the second contact point 237 is located in the lowest position of the plate-shaped second contact member 137, and the third contact point 217 is located in a center of the plate-shaped third contact member 117.

A plane, including the third contact point 217, which is parallel to the man scanning direction of the exposure and a direction of a biasing force of the third contact member 117 against the second side surface 34*c*, is defined as a third standard plane 217*a*. In addition, a plane, including the first contact point 207, which is parallel to the third standard plane 217*a*, is defined as a first standard plane 207*a*. Further, a plane, including the second contact point 237, which is parallel to the third standard plane 217*a*, is defined as a second standard plane 237*a*. The third contact point 217 is placed between the first and second standard planes 207*a* and 237*a* to contact the second side surface 34*c*.

Figure 15F:
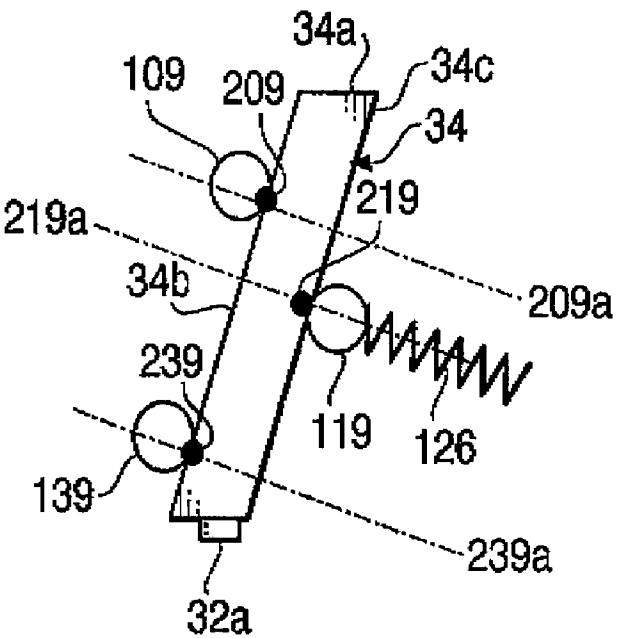
FIG. 15F shows a first contact point between a first contact member and a longitudinal supporting body, second contact point between a second contact member and the longitudinal supporting body, and third contact point between a third contact member and the longitudinal supporting body in a seventh embodiment according to one or more aspects of the present invention.
Figure 15E:
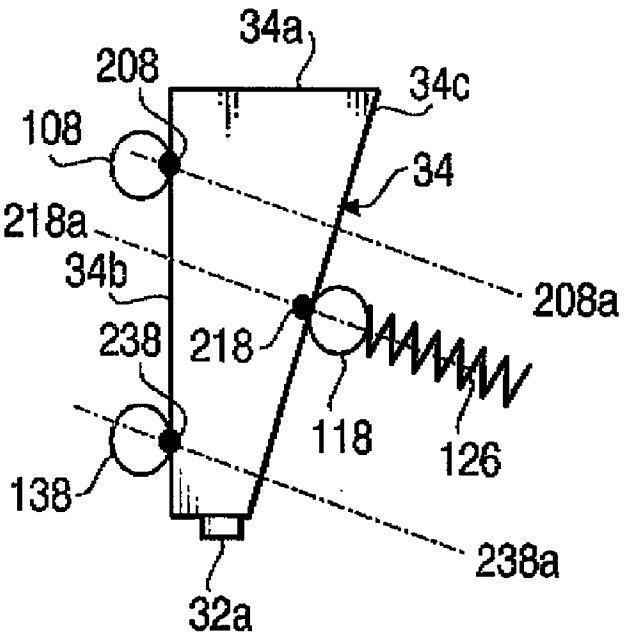
FIG. 15E shows a first contact point between a first contact member and a longitudinal supporting body, second contact point between a second contact member and the longitudinal supporting body, and third contact point between a third contact member and the longitudinal supporting body in a sixth embodiment according to one or more aspects of the present invention.

FIG. 15E schematically shows a sixth embodiment in which each of first, second, and third contact members 108, 138, and 118 is configured with a roller, and a first side surface 34*b* is not parallel to a second side surface 34*c*. A point in which the first contact member 108 contacts the first side surface 34*b* is a first contact point 208. In addition, a point in which the second contact member 138 contacts the first side surface 34*b* is a second contact point 238. Further, a point in which the third contact member 118 contacts the second side surface 34*c* is a third contact point 218.

A plane, including the third contact point 218, which is parallel to the main scanning direction of the exposure and a direction of a biasing force of the third contact member 118 against the second side surface 34*c*, is defined as a third standard plane 218*a*. In addition, a plane, including the first contact point 208, which is parallel to the third standard plane 218*a*, is defined as a first standard plane 208*a*. Further, a plane, including the second contact point 238, which is parallel to the third standard plane 218*a*, is defined as a second standard plane 238*a*. The third contact point 218 is placed between the first and second standard planes 208*a* and 238*a* to contact the second side surface 34*c*.

FIG. 15F schematically shows a seventh embodiment in which each of first, second, and third contact members 109, 139, and 119 is configured with a roller, and a longitudinal supporting body 34 has a parallelogram cross-section along a plane perpendicular to the main scanning direction of the exposure. A point in which the first contact member 109 contacts a first side surface 34*b* is a first contact point 209. In addition, a point in which the second contact member 139 contacts the first side surface 34*b* is a second contact point 239. Further, a point in which the third contact member 119 contacts a second side surface 34*c* is a third contact point 219.

A plane, including the third contact point 219, which is parallel to the main scanning direction of the exposure and a direction of a biasing force of the third contact member 119 against the second side surface 34*c*, is defined as a third standard plane 219*a*. In addition, a plane, including the first contact point 209, which is parallel to the third standard plane 219*a*, is defined as a first standard plane 209*a*. Further, a plane, including the second contact point 239, which is parallel to the third standard plane 219*a*, is defined as a second standard plane 239*a*. The third contact point 219 is placed between the first and second standard planes 209*a* and 239*a* to contact the second side surface 34*c*.

In the aforementioned sixth and seventh embodiments, FIG. 15E shows the second side surface 34*c* slanting to the right, while FIG. 15F shows the first and second side surfaces 34*b* and 34*c* both slanting to the right. However, the first and second side surfaces 34*b* and 34*c* may slant to the left.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a first device body having an opening;

a second device body attached to the first device body in an openable and closable manner so as to cover the opening of the first device body;

a photoconductive body, provided to the first device body, which is configured with a circumferential surface thereof endlessly-movable in a predetermined moving direction;

an exposure unit, provided to the second device body, which is configured to scan and expose the circumferential surface of the photoconductive body with light in a predetermined scanning direction such that a latent image is formed on the circumferential surface, the exposure unit including:

an exposure surface configured to emit therefrom the light for the scanning operation;

an opposed surface disposed to face the exposure surface;

a first side surface disposed to connect the exposure surface with the opposed surface; and a second side surface disposed to face the first side surface; and a positioning mechanism having at least three contact members disposed to stably position the exposure unit with respect to the photoconductive body when the second device body is closed, the at least three contact members including:

a first contact member comprising a roller configured to rotate and configured to contact the exposure unit in a first contact point at a side of the first side surface;

a second contact member configured to contact the exposure unit in a second contact point at the side of the first side surface, the second contact point being located closer to the exposure surface than the first contact point in a predetermined direction from the exposure surface toward the opposed surface; and a third contact member comprising a roller configured to rotate and configured to contact the exposure unit in a third contact point at a side of the second side surface, the third contact point being located between the first contact point and the second contact point in the predetermined direction.

2. The image forming device according to claim 1, wherein the second contact member is disposed closer to the exposure surface than the first contact member in the predetermined direction, and wherein at least one of the first contact member and the third contact member is configured with a roller.

3. The image forming device according to claim 2, wherein each of the first contact member and the third contact member is configured with a roller.

4. The image forming device according to claim 3, wherein the second contact member is configured with a roller as well as the first contact member and the third contact member.

5. The image forming device according to claim 1, wherein the second contact member includes a flat contact surface, wherein the exposure unit includes an opposed flat contact surface including the second contact point, wherein the flat contact surface establishes surface-to-surface contact with the opposed flat contact surface, and wherein the second contact point is defined as the closest point on the opposed flat contact surface to the photoconductive body in the predetermined direction from the exposure surface toward the opposed surface.

6. The image forming device according to claim 5, wherein the exposure unit includes a protruded portion provided near an end of the exposure surface in the predetermined scanning direction, and wherein the protruded potion includes the opposed flat contact surface.

7. The image forming device according to claim 5, wherein the third contact member includes a second flat contact surface, wherein the exposure unit includes a second opposed flat contact surface including the third contact point, wherein the second flat contact surface establishes surface-to-surface contact with the second opposed flat contact surface, and wherein the second contact point is defined as a center on the second opposed flat contact surface in the predetermined direction.

8. The image forming device according to claim 7, wherein the first contact member includes a third flat contact surface, wherein the exposure unit includes a third opposed flat contact surface including the first contact point, wherein the third flat contact surface establishes surface-to-surface contact with the third opposed flat contact surface, and wherein the first contact point is defined as the farthest point on the third opposed flat contact surface from the photoconductive body in the predetermined direction.

9. The image forming device according to claim 1, wherein the exposure unit is biased by the third contact member toward the first contact member and the second contact member.

10. The image forming device according to claim 1, wherein the exposure unit includes a fourth contact member configured to establish direct contact with the circumferential surface of the photoconductive body in a fourth contact point, wherein the third contact member is located at an upstream side in the predetermined moving direction with respect to the fourth contact point, and wherein the first contact member and the second contact member are located at a downstream side in the predetermined moving direction with respect to the fourth contact point.

11. The image forming device according to claim 1, wherein the exposure unit includes a plurality of light emitting elements aligned in the predetermined scanning direction on the exposure surface, and wherein the exposure unit linearly scans and exposes the circumferential surface of the photoconductive body in the predetermined scanning direction with light emitted by the plurality of light emitting elements.

12. The image forming device according to claim 1, wherein the second side surface faces the first side surface to be parallel to the first side surface.

13. An image forming device, comprising:

a photoconductive body configured with a circumferential surface thereof endlessly-movable in a predetermined moving direction;

an exposure unit configured to scan and expose the circumferential surface of the photoconductive body with light in a predetermined scanning direction such that a latent image is formed on the circumferential surface, the exposure unit including:

an exposure surface configured to emit therefrom the light for the scanning operation;

an opposed surface disposed to face the exposure surface;

a first side surface disposed to connect the exposure surface with the opposed surface; and a second side surface disposed to face the first side surface; and a positioning mechanism having at least three contract members disposed to stably position the exposure unit with respect to the photoconductive body, the at least three contact members including:

a first contact member comprising a roller configured to rotate and configured to contact the exposure unit in a first contact point at a side of the first side surface;

a second contact member configured to contact the exposure unit in a second contact point at the side of the first side surface, the second contact point being located closer to the exposure surface than the first contact point in a predetermined direction from the exposure surface toward the opposed surface; and a third contact member comprising a roller configured to rotate and configured to contact the exposure unit in a third contact point at a side of the second side surface, the third contact point being located between the first contact point and the second contact point in the predetermined direction.

14. The image forming device according to claim 13, further comprising:

a first device body having an opening; and a second device body attached to the first device body in an openable and closable manner so as to cover the opening of the first device body, wherein the photoconductive body is provided to the first device body, wherein the exposure unit is provided to the second device body, and wherein the at least three contact members stably position the exposure unit with respect to the photoconductive body when the second device body is closed.

15. The image forming device according to claim 1, wherein the second contact member is offset from the first contact member in an axial direction of the photoconductive body.

* * * * *